US010060212B2

(12) United States Patent
Conniff

(10) Patent No.: US 10,060,212 B2
(45) Date of Patent: Aug. 28, 2018

(54) HYDROSTATIC SETTING MECHANISM FOR A SUBTERRANEAN TOOL WITHOUT RUPTURE DISCS

(71) Applicant: BAKER HUGHES INCORPORATED, Houston, TX (US)

(72) Inventor: Paul J. Conniff, Aberdeen (GB)

(73) Assignee: Baker Hughes, a GE company, LLC, Houston, TX (US)

( * ) Notice: Subject to any disclaimer, the term of this patent is extended or adjusted under 35 U.S.C. 154(b) by 868 days.

(21) Appl. No.: 14/563,441

(22) Filed: Dec. 8, 2014

(65) Prior Publication Data

US 2016/0160594 A1 Jun. 9, 2016

(51) Int. Cl.
*E21B 23/04* (2006.01)
*E21B 23/06* (2006.01)

(52) U.S. Cl.
CPC ..... *E21B 23/04* (2013.01); *E21B 23/06* (2013.01)

(58) Field of Classification Search
CPC ..... E21B 23/04; E21B 23/06
See application file for complete search history.

(56) References Cited

U.S. PATENT DOCUMENTS

| | | | | |
|---|---|---|---|---|
| 7,231,987 | B2 | 6/2007 | Kilgore et al. | |
| 2005/0126789 | A1 | 6/2005 | Nivens et al. | |
| 2008/0236844 | A1 | 10/2008 | Gaudette et al. | |
| 2010/0200245 | A1 | 8/2010 | Ringgenberg et al. | |
| 2010/0236781 | A1 | 9/2010 | Mytopher et al. | |
| 2011/0036585 | A1 | 2/2011 | Sinclair | |
| 2012/0168146 | A1* | 7/2012 | Filas | E21B 23/04 166/66.5 |
| 2014/0048281 | A1 | 2/2014 | Acosta et al. | |

* cited by examiner

*Primary Examiner* — D. Andrews
*Assistant Examiner* — Kristyn A Hall
(74) *Attorney, Agent, or Firm* — Steve Rosenblatt

(57) ABSTRACT

A hydrostatically set tool operates by pressure buildup on one side of a piston that builds up pressure to the same degree on the opposite side of the piston. There is a valve assembly on the opposite side of the piston that at a predetermined pressure on a high pressure side of the valve assembly allows the assembly to open to mix high pressure on the opposite side of the piston with pressure in an atmospheric or low pressure chamber. This reduces the pressure on one side of the piston and makes the piston move to set the tool. Optionally the piston can be urged to move with low pressure differential such as with sizing of the port leading into the atmospheric chamber so that piston bore warping is reduced from the low differential pressures.

15 Claims, 3 Drawing Sheets

HYDROSTATIC SETTING MECHANISM FOR A SUBTERRANEAN TOOL WITHOUT RUPTURE DISCS

FIELD OF THE INVENTION

The field of the invention is hydrostatically operated setting mechanisms and more particularly those that communicate access to a low pressure reservoir to create pressure differential to move an actuator without using rupture discs.

BACKGROUND OF THE INVENTION

One way subterranean tools are actuated is to use the force of the hydrostatic pressure from well fluids at a specific location either alone or in conjunction with surface applied pressure, to set a tool. Typically this is done with an actuation piston exposed on one side to a low pressure and on the other side to wellbore hydrostatic acting on one side of a rupture disc. The piston is in pressure balance as long as the rupture disc is integral. At a predetermined depth the rupture disc is supposed to fail to expose one side of the piston to hydrostatic pressure. With the opposed side exposed to atmospheric pressure there is a net force on the piston which starts piston movement to actuate the tool.

Annular pistons have traditionally been used to actuate subterranean tools but more recently with the operating depths of tools increasing there has been a shift to the use of multiple rod pistons actuated with a breaking rupture disc. One such device is illustrated in U.S. Pat. No. 7,231,987. There are several issues with such designs. One is that large differential pressure from the hydrostatic pressure at deep locations and an atmospheric chamber at an opposite end of a rod piston tend to warp the piston bore from pressure differential. The other problem is that the rupture disc does not reliably burst at the desired pressure and in some applications can also fragment into small parts that can affect function of nearby components.

More recently a design was developed to keep rod pistons in pressure balance and actuate the piston with low pressure differential that is obtained by pressure buildup on opposed sides of the piston to keep the piston in pressure balance but at a predetermined time one side has a rupture disc that communicates with a low pressure chamber. As a result of the intermingling of high pressure with the atmospheric chamber there results a net force imbalance on the rod pistons and they are urged to move to set a subterranean tool such as a packer. A design that does this is shown in US 2014/0048281. The way it operates, shown in FIGS. 1-4 is the rupture disc 122 isolates a third chamber 124 from a first chamber 114 by closing off passage 148 between them. The second passage 115 is open through port 120 to annulus pressure. As the tool is lowered annulus pressure communicates through port 120 into the second chamber 115 and that communication raises the pressure in first chamber 114 without piston 112*a* movement. However as the pressure rises in the first chamber 114 the pressure differential on the rupture disc 122 rises while the third chamber pressure stays at a predetermined lower value such as atmospheric. At a predetermined differential across the rupture disc 122, it breaks to combine the first chamber 114 with the third chamber 124 to reduce the aggregate pressure to below the pressure in the second chamber 115 from annulus pressure through ports 120. The piston 112*a* moves in the direction of arrow A to set the packer 110.

While this design with a setting with low differential pressure was designed to address the issue of bore warping at high differential pressures for the rod pistons, it left unaddressed the issue of rupture discs and their variability of failure pressures that could result in tool setting at depths different than was intended. Other issues with rupture discs are that fragments can form upon burst that can disturb the operation of tools that are down the line. Another factor is the cost of the rupture discs and the assembly time and cost associated with mechanical assembly of the tool.

The present invention addresses these issues with elimination of the rupture disc while still allowing selective access between a high and lower pressure chamber on one side of the piston or pistons so that a differential pressure occurs to move the piston or pistons to set the tool. In the preferred embodiment the tool is a packer but other tools are contemplated. The pressure buildup against a spring biased piston allows for more predictable setting pressures for the tool in question. These and other aspects of the present invention will be more readily apparent to those skilled in the art from a review of the description of the preferred embodiment and the associated drawings while understanding that the full scope of the invention is to be determined by the appended claims.

SUMMARY OF THE INVENTION

A hydrostatically set tool operates by pressure buildup on one side of a piston that builds up pressure to the same degree on the opposite side of the piston. There is a valve assembly on the opposite side of the piston that at a predetermined pressure on a high pressure side of the valve assembly allows the assembly to open to mix high pressure on the opposite side of the piston with pressure in an atmospheric or low pressure chamber. This reduces the pressure on one side of the piston and makes the piston move to set the tool. Optionally the piston can be urged to move with low pressure differential such as with sizing of the port leading into the atmospheric chamber so that piston bore warping is reduced from the low differential pressures.

DETAILED DESCRIPTION OF THE PREFERRED EMBODIMENT

Figure 1:
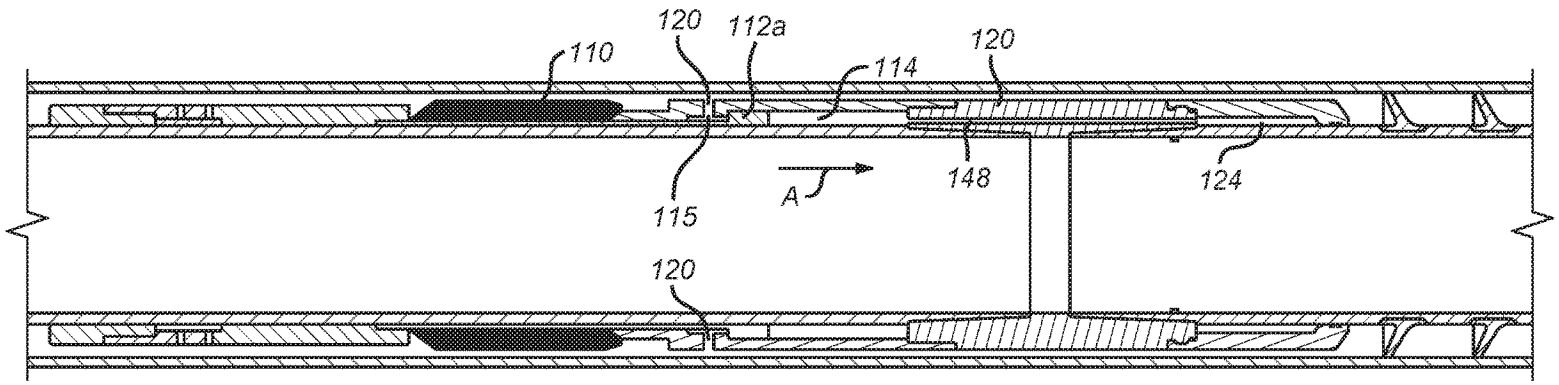
(PRIOR ART) FIG. 1
FIGS. 1-4 are section views of a prior design tool that uses a rupture disc to communicate one side of a piston to a low pressure chamber for low differential pressure tool actuation.
Figure 2:
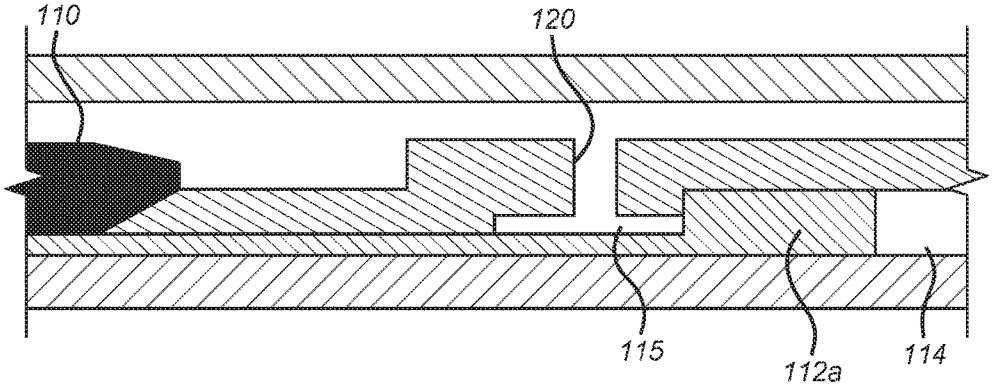
(PRIOR ART) FIG. 2
Figure 3:
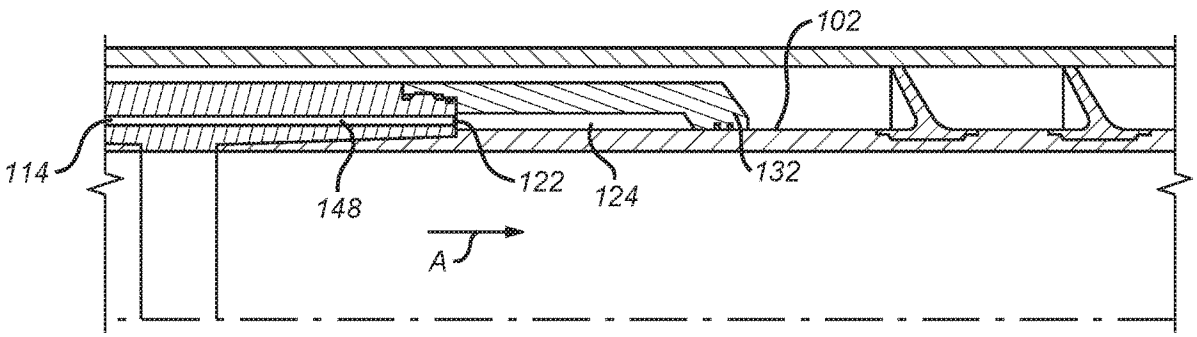
(PRIOR ART) FIG. 3
Figure 4:
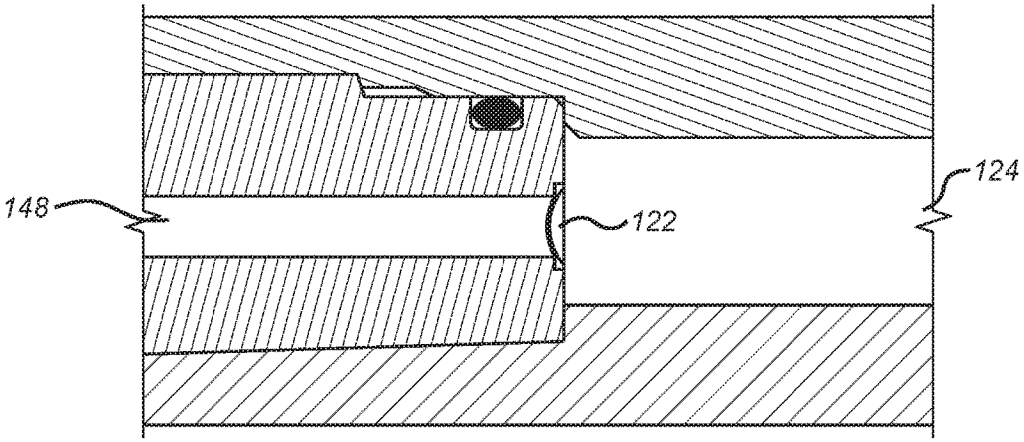
(PRIOR ART) FIG. 4
Figure 5:
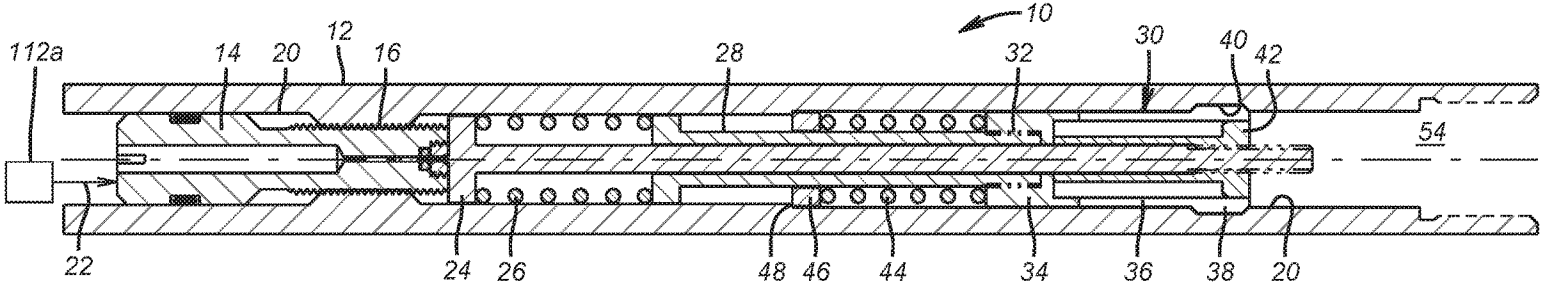
FIG. 5 is a section view of the valve mechanism that replaces the rupture disc of FIGS. 1-4 in the run in position.
Figure 6:
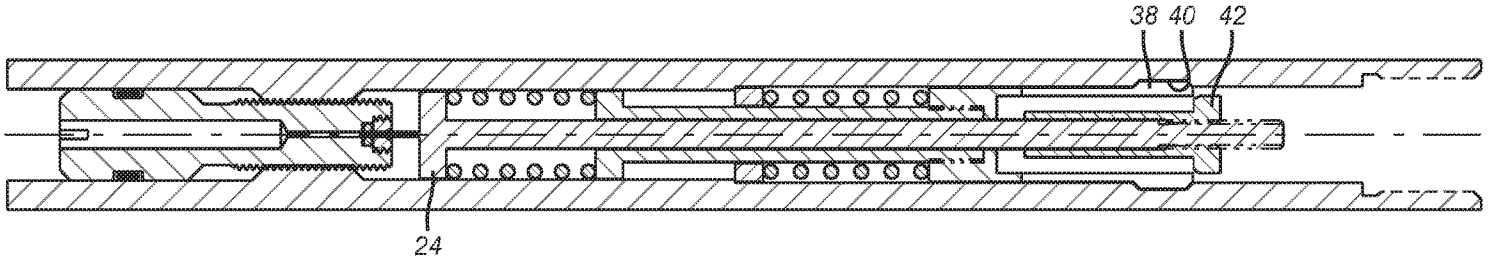
FIG. 6 is the view of FIG. 5 in the stroked position.
Figure 7:
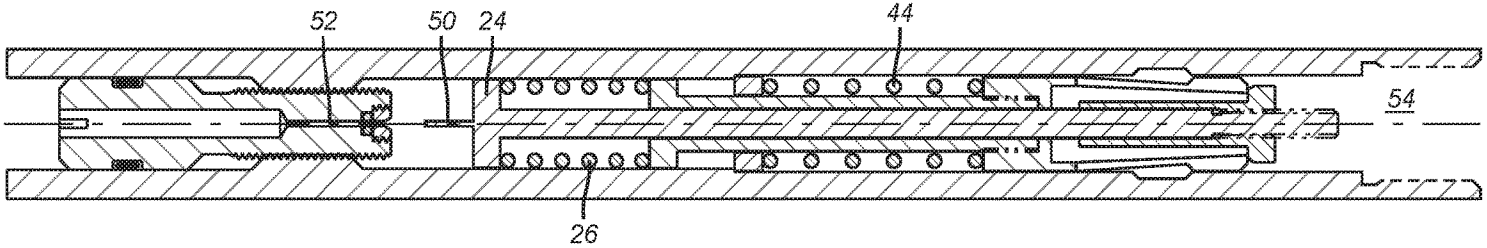
FIG. 7 is the view of FIG. 5 in the released position.

Referring to FIG. 5 the valve assembly 10 is the structure intended to replace rupture disc 122 in FIGS. 1-4. It has a housing 12 with a preload adjuster 14 that is threaded at 16 to the housing 12. Adjusting the preload adjuster controls the pressure at which the valve opens. This allows use of a single device that can be set to actuate at different depths. It saves having an inventory of valves for different applications and because it no longer uses rupture disc, it eliminates the need for a large inventory of rupture discs to suit different setting depths as in the past. A seal 18 against inner wall 20 redirects pressure represented by arrow 22 against a plunger 24 located at a first end. Plunger 24 is biased by a spring 26 toward the adjuster 14. In the other direction, spring 26 pushes against collet extension 28 which is threaded to collet assembly 30 at thread 32. Collet assembly 30 has a base ring 34 and a plurality of axially extending fingers 36 that terminate at heads 38 that are initially in groove 40 in inner wall 20. Plunger 24 has a radially extending support member 42 that holds the heads 38 in groove 40. Meantime spring 44 bears at one end on support ring 46 which is backed by a shoulder 48 which is part of inner wall 20. Spring 44 puts a downward force on collet assembly 30 in FIG. 5 but the heads 38 trapped in grove 40 prevent any movement of the heads 38. Spring 26 is supported by heads 38 locked in groove 40 due to the threaded connection 32. However, as the operating depth increases so does the hydrostatic pressure on one side of the actuating piston 112*a* shown in FIG. 1 which has the effect of increasing the pressure on the opposite side of the same piston as represented by arrow 22. Pressure may also be increased manually, additive to the well hydrostatic pressure. Eventually the pressure acting on the plunger 24 overcomes the opposing force of spring 26 as shown in FIG. 6. Movement of the plunger 24 takes the support member 42 axially away from heads 38 so that the force of spring 44 can then push the collet heads 38 axially out of groove 40 as shown in FIG. 7. When that happens a plunger extension 50 comes out of bore or passage 52 to which it was previously located. In the FIG. 5 or 6 position the extension 50 is still sealed in bore 52 but in FIG. 7 there has been enough axial movement to break the seal. At this time pressure represented by arrow 22 communicates with chamber 54, located at an opposed end that was initially at low pressure or atmospheric pressure. The result is differential pressure on the piston 112*a* shown in FIGS. 1-4 but used in FIGS. 5-7 and piston movement that sets the connected tool. The tool can have a lock feature that prevents return movement after a single operational movement at the subterranean location.

The above description is illustrative of the preferred embodiment and many modifications may be made by those skilled in the art without departing from the invention whose scope is to be determined from the literal and equivalent scope of the claims below.

I claim:

1. An actuation assembly for moving an actuating member to operate a subterranean tool, comprising:

an actuating member exposed to hydrostatic pressure at a subterranean location at a first end such that increasing hydrostatic pressure increases pressure at an opposed end, said opposed end connected to a housing that further comprises:

a pressure responsive valve assembly non-destructively operable responsive to a pressure increase at the subterranean location to communicate said opposed end to at least one chamber having a lower pressure than said opposed end for a pressure reduction at said opposed end as compared to said first end for initial movement of said actuating member to operate the subterranean tool, said communicating said opposed end occurring from a release of stored potential energy as a result of initial movement of at least a part of said valve assembly responsive to the pressure increase.

2. The assembly of claim 1, wherein:

said valve assembly further comprising a lock assembly selectively defeated for opening of said valve assembly.

3. An actuation assembly for moving an actuating member to operate a subterranean tool, comprising:

an actuating member exposed to hydrostatic pressure at a subterranean location at a first end such that increasing hydrostatic pressure increases pressure at an opposed end, said opposed end connected to a housing that further comprises:

a pressure responsive valve assembly non-destructively operable responsive to a pressure increase to communicate said opposed end to at least one chamber having a lower pressure than said opposed end for a pressure reduction at said opposed end as compared to said first end for movement of said actuating member to operate the subterranean tool;

said applied pressure at said opposed end defeats a lock holding said valve assembly closed.

4. An actuation assembly for moving an actuating member to operate a subterranean tool, comprising:

an actuating member exposed to hydrostatic pressure at a subterranean location at a first end such that increasing hydrostatic pressure increases pressure at an opposed end, said opposed end connected to a housing that further comprises:

a pressure responsive valve assembly non-destructively operable responsive to a pressure increase to communicate said opposed end to at least one chamber having a lower pressure than said opposed end for a pressure reduction at said opposed end as compared to said first end for movement of said actuating member to operate the subterranean tool;

said valve assembly comprises an extending member in sealing contact with a passage in said housing in a closed position for said valve assembly.

5. The assembly of claim 4, wherein:

said extending member moving out of said passage to allow pressure equalization between said opposed end and said chamber.

6. An actuation assembly for moving an actuating member to operate a subterranean tool, comprising:

an actuating member exposed to hydrostatic pressure at a subterranean location at a first end such that increasing hydrostatic pressure increases pressure at an opposed end, said opposed end connected to a housing that further comprises:

a valve assembly non-destructively operable to communicate said opposed end to at least one chamber having a lower pressure than said opposed end for a pressure reduction at said opposed end as compared to said first end for movement of said actuating member to operate the subterranean tool;

said valve assembly comprises an extending member in sealing contact with a passage in said housing in a closed position for said valve assembly;

said extending member moving out of said passage to allow pressure equalization between said opposed end and said chamber;

initial movement of said extending member also moves a component of a locking member for reduction of a restorative force acting to push said extending member into said passage.

7. The assembly of claim 6, wherein:

said restorative force is provided by a first biasing member temporarily supported to said housing.

8. The assembly of claim 7, wherein:

said temporary support comprises at least one collet selectively retained to a groove in said housing.

9. The assembly of claim 8, wherein:

said at least one collet is released from said groove with axial tandem movement of said extending member and a plunger.

10. The assembly of claim 9, wherein:

said at least one collet is axially biased out of said groove by a second biasing member in the same direction as movement of said plunger that allowed said at least one collet to exit said groove.

11. The assembly of claim 10, wherein:

said first biasing member is undermined by movement of said at least one collet from said groove.

12. The assembly of claim 10, wherein:

said at least one collet remains outside said groove on said biasing force from said second biasing member.

13. The assembly of claim 10, wherein:

said first biasing member further comprises an adjustable preload member threaded to said housing to adjust initial restorative force of said first biasing member to push said extending member into said passage.

14. The assembly of claim 13, wherein:

said valve assembly opens at different subterranean depths depending on the position of said adjustable preload member.

15. An actuation assembly for moving an actuating member to operate a subterranean tool, comprising:

an actuating member exposed to hydrostatic pressure at a subterranean location at a first end such that increasing hydrostatic pressure increases pressure at an opposed end, said opposed end connected to a housing that further comprises:

a valve assembly non-destructively operable to communicate said opposed end to at least one chamber having a lower pressure than said opposed end for a pressure reduction at said opposed end as compared to said first end for movement of said actuating member to operate the subterranean tool;

said valve assembly responsive to applied pressure at said opposed end defeats to defeat a lock holding said valve assembly closed;

said valve assembly comprises an extending member in sealing contact with a passage in said housing in a closed position for said valve assembly.

* * * * *